US005711462A

United States Patent [19]

Hard

[11] Patent Number: 5,711,462

[45] Date of Patent: Jan. 27, 1998

[54] DRYWALL TOOL FILLING PUMP

[76] Inventor: Dave Hard, 423 Wilson La., Windsor, Calif. 95492

[21] Appl. No.: 653,487

[22] Filed: May 24, 1996

[51] Int. Cl.[6] ..... B67D 5/40

[52] U.S. Cl. ..... 222/385; 141/26; 417/238

[58] Field of Search ..... 222/385; 141/18, 141/25–27; 417/238

[56] References Cited

U.S. PATENT DOCUMENTS

| | | | |
|---|---|---|---|
| 1,076,488 | 10/1913 | Deming | 222/385 |
| 3,231,148 | 1/1966 | Miller | 222/385 X |
| 5,150,837 | 9/1992 | Ferrari | 222/385 X |

FOREIGN PATENT DOCUMENTS

| | | | |
|---|---|---|---|
| 625739 | 8/1961 | Canada | 141/26 |

OTHER PUBLICATIONS

Premier Drywall Tool Co. Tool Manual, pp. 4, 5, 24, 25.
Doerock Inc. Versa–Tool brochure.
Concorde Tool Corp. brochure.
TapeMaster brochure.
TapeTech brochure, cover and p. 3.
Precision Taping Tools brochure, front and back sides.
Ames brochure, cover and p. 4.
Speed Pump parts diagram.

*Primary Examiner*—Kevin P. Shaver
*Attorney, Agent, or Firm*—Jack Lo

[57] ABSTRACT

A drywall tool filling pump includes a pump head removably attached to the top end of a pump cylinder positioned inside a bucket of drywall mud. Left and right hinge members extend from the pump head. A plunger shaft extends coaxially from the pump head. A lever has a proximal end pivotally attached to the top of the plunger shaft, and is positionable on either side of the pump head. A pair of connecting rods pivotally connect an intermediate portion of the lever to either hinge member. An output port arranged on the pump head may be connected to a variety of automatic drywall tools. A L-shaped mounting bracket has a top end attached to the output port, and extends downwardly for being positioned outside the bucket. A valve cap is attached to the lower end of the pump cylinder by bolts that extend through longitudinal slots on the cylinder, so that the valve cap may be easily removed by loosening the bolts, and sliding them out the slots. The lever may be easily configured for either right-handed or left-handed use by positioning it on either side of the pump head, and attaching the connecting rod to the corresponding hinge member with a removable pin. In the course of a workday, a worker may switch the position of the lever so as to exercise both arms evenly.

10 Claims, 3 Drawing Sheets

DRYWALL TOOL FILLING PUMP

BACKGROUND OF THE INVENTION

1. Field of the Invention

This invention relates generally to pumps, specifically to a pump for filling automatic drywall tools with drywall mud.

2. Prior Art

Many types of buildings are typically constructed with timber frames covered with wallboards, which are formed by a layer of plaster sandwiched between two sheets of cardboard. This type of construction is known as drywall construction. The joints between the wallboards are covered with drywall tape and smoothed with drywall mud. A variety of automatic tools are used for applying the tape and mud. Such tools include built-in reservoirs for holding a moderate supply of mud. A separate filling pump must be used to fill the tools with mud from a bucket.

The pump includes a pump head, a cylinder removably attached to the bottom thereof for being positioned inside the bucket of mud, and a single hinge member fixedly extending from one side of the pump head. A lever has a proximal end pivotally attached to the top of a plunger shaft extending from the pump head. A pair of connecting rods pivotally connect an intermediate portion of the lever to the sides of the hinge member. An output port arranged on the side of the pump head may be attached to any automatic drywall tool with one of two standard adapters. A vertical mounting bracket positioned between the output port and the hinge member extends downwardly from the pump head for being positioned outside the bucket. A horizontal portion at the bottom of the mounting bracket is stepped on by a user for steadying the pump during use. A one-way valve cap is removably attached to the lower or intake end of the cylinder by bolts that extend through holes on the cylinder wall and into the end cap. Substantially identical filling pumps are sold by Premier Drywall Tool Co. of Stockton, Calif.; Doerock Inc. of Arthur, Ill.; Concord Tool Corporation of Canada; TapeMaster Tool Co. Inc. of Union City, Calif.; Precision Taping Tools of Arthur, Ill.; and Ames of Duluth, Ga.

All filling pumps must be disassembled at the end of each work day and cleaned thoroughly to prevent the mud from hardening therein. Removing the valve cap is inconvenient, because both bolts must be completely removed from the cylinder before the valve cap may be released.

Furthermore, the lever of all prior art filling pumps is positioned for right-handed use only. During the course of a typical work day, a worker must fill and refill his tools over and over again, and pump the lever a total of several hundred times. The right arm and shoulder muscles are thus heavily exercised during every workday, but the left arm and shoulder muscles are not. After many years, a typical drywall worker will have severely uneven muscle development between the two sides of his body, which leads to serious posture, muscular, and skeletal problems.

OBJECTS OF THE INVENTION

Accordingly the primary object of the present invention is to provide a drywall tool filling pump that can be easily adapted for either right-handed or left-handed use, so that a worker can exercise both arms evenly during each workday, and avoid developing potentially serious health problems.

Another object of the present invention is to provide a drywall tool filling pump with a valve cap that is very easy to remove.

Yet another object of the present invention is to provide a drywall tool filling pump that can be used for filling a variety of automatic drywall tools.

Further objects of the present invention will become apparent from a consideration of the drawings and ensuing description.

SUMMARY OF THE INVENTION

A drywall tool filling pump includes a pump head, and a cylinder removably attached to the bottom thereof for being positioned vertically inside a bucket of mud. Left and right hinge members extend from opposite positions on the pump head. A lever has a proximal end pivotally attached to the top of a plunger shaft extending coaxially from the pump head. The lever may be positioned on either the left or right side of the cylinder. A pair of connecting bars pivotally connect an intermediate portion of the lever to one of the hinge members. An output port is arranged on the pump head intermediate the hinge members. A L-shaped mounting bracket has a top end attached to the output port, and extends downwardly for being positioned outside the bucket. The horizontal portion at the bottom of the mounting bracket is stepped on by a worker for steadying the pump during use. A one-way valve cap is attached to the lower end of the cylinder by bolts that extend through longitudinal slots on the cylinder, so that the valve cap may be easily removed by loosening the bolts, and sliding them out the slots.

The lever may be easily positioned for either right-handed or left-handed use by attaching the connecting bars to either the right or left hinge member. During the course of a workday, the worker may switch the position of the lever so as to exercise both arms evenly.

Figure 1:
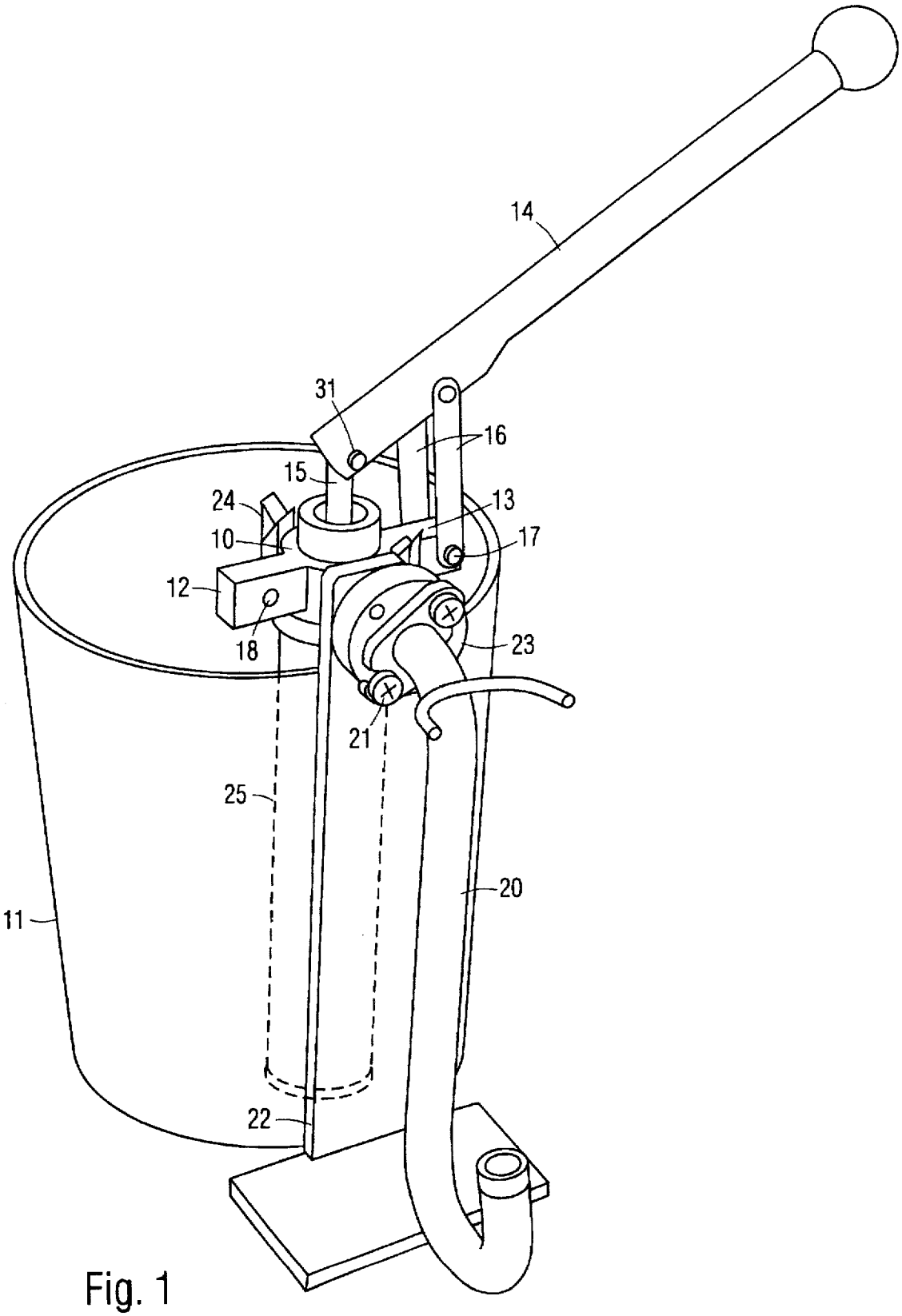
FIG. 1 is a left side perspective view of a drywall tool filling pump with a lever in the right-handed position in accordance with a preferred embodiment of the invention.

| Drawing Reference Numerals | |
|---|---|
| 10. Pump Head | 11. Drywall Mud Bucket |
| 12. Left Hinge Member | 13. Right Hinge Member |
| 14. Lever | 15. Plunger Shaft |
| 16. Connecting Bars | 17. Pin |
| 18. Hole | 19. Hole |
| 20. Adapter Tube | 21. Bolts |
| 22. L-Shaped Mounting Bracket | 23. Output Port |
| 24. Retaining Clips | 25. Pump Cylinder |
| 26. Output Tube | 27. Diagonal Slot |
| 28. Valve Cap | 29. Bolt |
| 30. Slot | 31. Pin |

DESCRIPTION—FIG. 1

Figure 4:
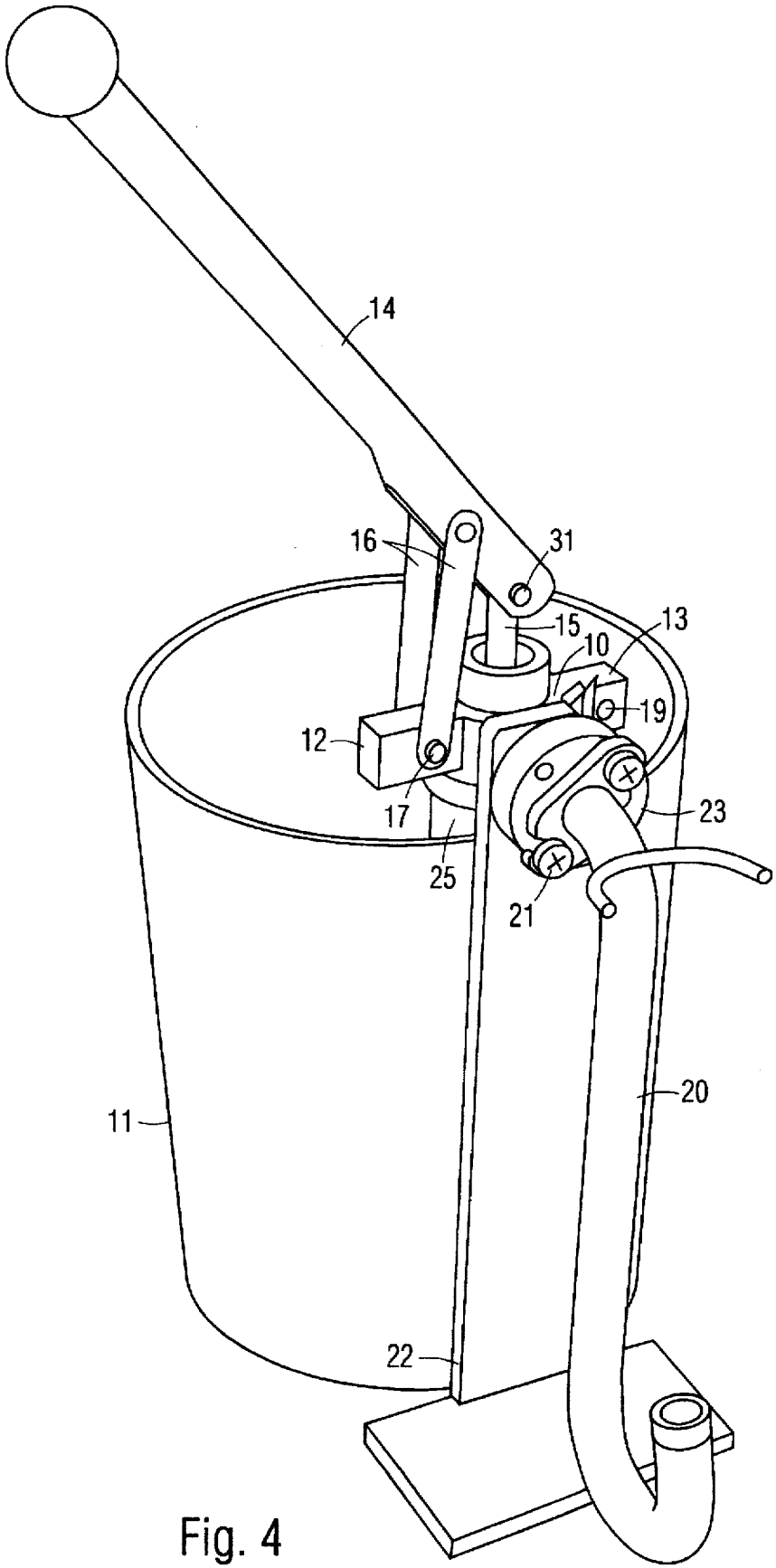
FIG. 4 is a left side perspective view of the drywall tool filling pump with the lever in the left-handed position.

In accordance with a preferred embodiment of the invention shown in the left side perspective view in FIG. 1, a drywall tool filling pump includes a pump head 10 and a pump cylinder 25 removably attached to the bottom thereof by a pair of retaining clips 24. Pump cylinder 25 is positioned inside a container or mud bucket 11. A left hinge member 12 and a right hinge member 13 extend from pump head 10 at opposite radial positions about the axis thereof. Hinge members 12 and 13 include horizontal holes 18 and 19 (FIG. 4) extending between the front and back sides thereof. A lever 14 has a proximal end pivotally and removably attached to the top of a plunger shaft 15 by a pin 31. Plunger shaft 15 extends slidably and coaxially from pump head 10 and is rotatable about the axis thereof. A pair of connecting bars 16 have top ends pivotally attached to lever 14 at a position spaced from shaft 15. The lower ends of bars 16 are pivotally and removably attached to right hinge member 13 with a pin 17 removably positioned through hole 19 (FIG. 4).

An output port 23 is attached to pump head 10 at a position intermediate hinge members 12 and 13. An exemplar adapter tube 20 is removably mounted to output port 23 with screws or bolts 21; other types of adapter tubes (not shown) may also be used. The adapter tube enables a variety of automatic drywall tools (not shown) to be attached to the filling pump. A L-shaped mounting bracket 22 has a top end attached to output port 23. Mounting bracket 22 is laterally spaced from pump cylinder 25 and positioned outside of bucket 11. The pump includes conventional internal components common to other drywall tool filling pumps.

The filling pump is shown in FIG. 1 configured for right-handed operation. To use, a worker attaches a conventional automatic drywall tool (not shown) to the distal end of adapter tube 20, and stands on the horizontal portion of L-shaped mounting bracket 22 with his right foot. He holds the tool being filled with his left hand, and pumps lever 14 with his right hand to fill it with mud.

DESCRIPTION—FIG. 2

Figure 2:
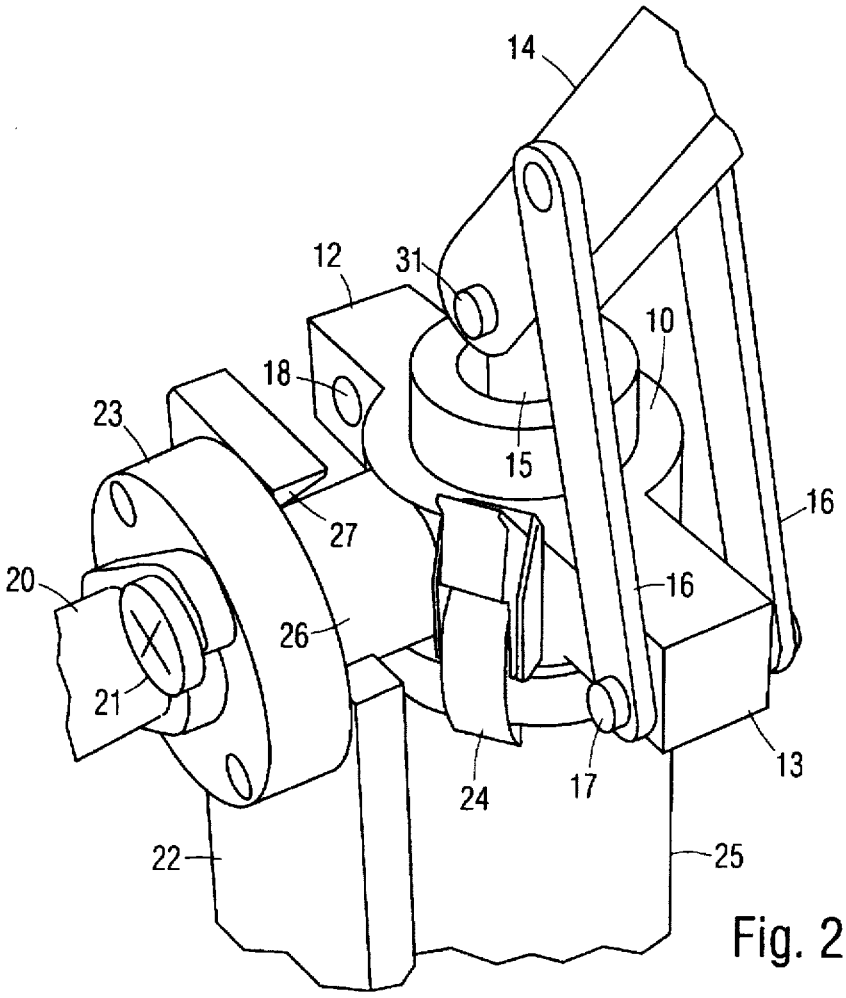
FIG. 2 is a right side perspective close-up view of the drywall tool filling pump.

Pump head 10 is shown in a right side view in FIG. 2. A short output tube 26 is connected between output port 23 and pump head 10. Output tube 26 and mounting bracket 22 are thus positioned intermediate hinge members 12 and 13, i.e., hinge member 12 and 13 are symmetrically attached to pump head 10 with respect to mounting bracket 22 and output tube 26. A diagonal notch 27 on the top of bracket 22 is positioned around output tube 26. Bucket 11 (FIG. 1) is not shown for clarity.

DESCRIPTION—FIG. 3

Figure 3:
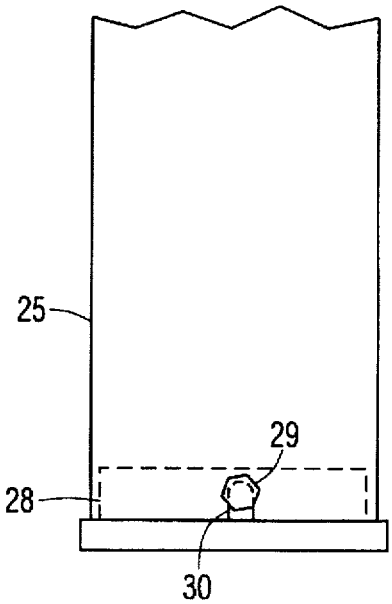
FIG. 3 is a side view of a lower end of a cylinder of the drywall tool filling pump.

The lower or intake end of pump cylinder 25 is shown in a side view in FIG. 3. A conventional one-way valve cap 28 is attached to the lower end of pump cylinder 25. A pair of longitudinal slots 30 (one shown) extend into pump cylinder 25 from a lower rim thereof. A pair of bolts 29 (one shown) extend through slots 30 and into the side of valve cap 28 to secure it to pump cylinder 25. Valve cap 28 may be easily removed for cleaning by simply loosening bolts 29, and sliding them longitudinally along pump cylinder 25 and out of slots 30.

DESCRIPTION—FIG. 4

As shown in the left side perspective view in FIG. 4, lever 14 is easily positioned for left-handed use by removing pin 17, rotating lever 14 to the left side of the pump, and connecting the lower ends of bars 16 to left hinge member 12 with pin 17.

The filling pump is thus configured for left-handed operation. To use, the worker attaches an automatic drywall tool (not shown) to the distal end of adapter tube 20, and stands on the horizontal portion of L-shaped mounting bracket 22 with his left foot. He holds the tool being filled with his right hand, and pumps lever 14 with his left hand to fill it with mud.

SUMMARY, SUBSTITUTES, AND SCOPE

Accordingly, I have provided a drywall tool filling pump that may be easily configured for either left-handed or right-handed use, so that a worker may exercise both arms evenly during each workday, and avoid developing potentially serious health problems. It includes a valve cap that may be very easily removed for cleaning, and it may be used for filling a variety of automatic drywall tools.

Although the above descriptions are specific, they should not be considered as limitations on the scope of the invention, but only as examples of the embodiments. Many substitutes and variations are possible within the teachings of the invention. For example, straight slots 30 may be replaced with L-shaped slots, so that valve cap 28 may be even more easily removed by twisting it within pump cylinder 25 and pulling it out, without having to turn bolts 29 at all. Output tube 26 and adapter tube 20 may be attached to pump head 10 at other positions, as long as hinge members 12 and 13 are symmetrically positioned on pump head 10 with respect to mounting bracket 22. Instead of two connecting bars 16, just one may be used. Output tube 26 may be eliminated, so that adapter tube 20 is attached directly to the upper end of pump head 10. Instead of two fixed hinge members 12 and 13, a single hinge member movable between the left and right sides of pump head 10 may be used. Bolts 29 may be replaced with thumbscrews or wing nuts, so that they may be loosened or tightened without tools. Valve cap 28 may be threaded into pump cylinder 25. Pump head 10 may be non-removably attached to pump cylinder 25. The pump may be used for filling other tools and devices with other substances. Therefore, the scope of the invention should be determined by the appended claims and their legal equivalents, not by the examples given.

I claim:

1. A drywall tool filling pump adaptable for either right-handed use or left-handed use, comprising:

a pump cylinder adapted to be positioned vertically inside a bucket of drywall mud;

a pump head attached to a top end of said pump cylinder, said pump head having left and right sides comprising radially opposite positions about an axis thereof;

a plunger shaft extending slidably and coaxially out of said pump head;

an output port means attached to said pump head and adapted to be connected to a drywall tool;

a vertical mounting bracket having an upper end connected to said pump head intermediate said left and right sides, said mounting bracket being adapted to be positioned outside said bucket;

a lever having a proximal end pivotally attached to an upper end of said plunger shaft, said lever being selectively positionable on either said left side or said right side; and a connecting bar having an upper end hingeably attached to an intermediate portion of said lever, and a lower end selectively positionable on said pump head on either said left side or said right, so that when said lever and said connecting bar are positioned on said right side, said lever is operable by the right hand of a worker, and when said lever and said connecting bar are positioned on said left side, said lever is operable by the left hand of the worker.

2. The drywall tool filling pump of claim 1 wherein said mounting bracket comprises a L-shaped mounting bracket having a horizontal lower end portion.

3. The drywall tool filling pump of claim 1, further including an adapter tube attached to said output port means, said adapter tube being adapted to be connected to said drywall tool.

4. The drywall tool filling pump of claim 1, further including a one-way valve cap removably attached to a lower end of said pump cylinder, a slot extending longitudinally into said pump cylinder from a lower rim thereof, and a bolt means extending through said slot and into a side of said valve cap so as to secure said valve cap in said pump cylinder, said valve cap being removable by sliding said bolt means longitudinally along said pump cylinder and out of said slot.

5. A filling pump adaptable for either right-handed use or left-handed use, comprising:

a pump cylinder;

a pump head attached to one end of said pump cylinder, said pump head having left and right sides comprising radially opposite positions about an axis thereof;

a plunger shaft extending slidably and coaxially out of said pump head;

left and right hinge members respectively extending from said left and right sides of said pump head;

a lever having a proximal end pivotally attached to an outer end of said plunger shaft, said lever being selectively movable to either said left side or said right side of said pump head; and a connecting bar having an upper end hingeably attached to an intermediate portion of said lever, and a lower end selectively attachable to either said left hinge member or said right hinge member, so that when said lever is positioned on said right side, and said lower end of said connecting bar is attached to said right hinge member, said lever is operable by the right hand of a worker, and when said lever is positioned on said left side, and said lower end of said connecting bar is attached to said left hinge member, said lever is operable by the left hand of the worker.

6. The filling pump of claim 5, further including an elongated mounting bracket having one end connected to said pump head intermediate said left and right hinge members, said pump cylinder being adapted to be positioned vertically inside a bucket so that said pump head is at a top end of said pump cylinder, said mounting bracket being adapted to be positioned outside said bucket.

7. The filling pump of claim 6 wherein said mounting bracket comprises a L-shaped mounting bracket.

8. The filling pump of claim 5, further including a removable pin for releasably attaching said lower end of said connecting bar to either one of said hinge members, said pin extending through said connecting bar and either one of said hinge members.

9. The filling pump of claim 5, further including an output port means attached to said pump head, and an adapter tube attached to said output port means, said adapter tube being adapted to be connected to a drywall tool.

10. The filling pump of claim 5, further including a one-way valve cap removably attached to another end of said pump cylinder, a slot extending longitudinally into said pump cylinder from a lower rim thereof, and a bolt means extending through said slot and into a side of said valve cap so as to secure said valve cap in said pump cylinder, said valve cap being removable by sliding said bolt means longitudinally along said pump cylinder and out of said slot.

* * * * *